US006539881B2

(12) United States Patent
Underbrink et al.

(10) Patent No.: US 6,539,881 B2
(45) Date of Patent: Apr. 1, 2003

(54) PALLET HAVING A PALLET DECK WITH A MOVABLE PORTION AND AN ASSOCIATED METHOD

(75) Inventors: Steven Leo Underbrink, Carnation, WA (US); James Robert Underbrink, Seattle, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/783,347

(22) Filed: Feb. 14, 2001

(65) Prior Publication Data

US 2002/0108540 A1 Aug. 15, 2002

Related U.S. Application Data

(60) Provisional application No. 60/267,050, filed on Feb. 7, 2001.

(51) Int. Cl.[7] ..... B65D 19/44
(52) U.S. Cl. ..... 108/55.3; 206/386
(58) Field of Search ..... 108/51.41, 55.1, 108/55.3, 54.1; 206/386

(56) References Cited

U.S. PATENT DOCUMENTS 3,285,204 A * 11/1966 Schweitzer, Jr. ..... 108/55.3
4,798,294 A * 1/1989 Bodi ..... 206/600
5,787,817 A 8/1998 Heil
5,911,179 A 6/1999 Spiczka
6,006,675 A 12/1999 Heil
6,035,790 A * 3/2000 Polando ..... 108/55.1
6,126,131 A * 10/2000 Tietz ..... 248/346.01
6,240,854 B1 * 6/2001 Hell ..... 108/51.11
6,360,676 B1 * 3/2002 Schepers ..... 108/52.1

FOREIGN PATENT DOCUMENTS

JP 64-70387 * 3/1989

* cited by examiner

*Primary Examiner*—Jose V. Chen
*Assistant Examiner*—Gerald A. Anderson
(74) *Attorney, Agent, or Firm*—Alston & Bird LLP

(57) ABSTRACT

A pallet and an associated method are provided for supporting an item mounted upon casters. The pallet includes a pallet deck having a fixed portion and a movable portion. The movable portion moves between a first position in which the movable portion is displaced, such as by being rotated downwardly, from the fixed portion and a second position in which the movable and fixed portions cooperate to define a support surface. The movable portion is in the second position while the item is loaded, but is moved to the first position during shipment. The pallet also includes a support for supporting the item once the movable portion is in the first position. Prior thereto, however, the item is typically spaced from the support. Each support can include a stationary portion and a movable portion that moves between a retracted position to facilitate loading and an extended position during shipment.

28 Claims, 5 Drawing Sheets

PALLET HAVING A PALLET DECK WITH A MOVABLE PORTION AND AN ASSOCIATED METHOD

CROSS-REFERENCE TO RELATED APPLICATION

The present application is related to and claims priority from U.S. Provisional Application No. 60/267,050 entitled *Self-Blocking Pallet with Integral Ramp* by Steven L. Underbrink and James R. Underbrink, filed Feb. 7, 2001, the contents of which are incorporated in their entirety herein.

FIELD OF THE INVENTION

The present invention relates generally to pallets and associated methods for loading items upon pallets and, more particularly, to pallets that are particularly adapted to support items mounted upon casters and associated methods of loading the items that are mounted upon the casters onto pallets.

BACKGROUND OF THE INVENTION

A variety of electronic and other equipment is stored and shipped in protective cases. For example, test equipment such as data acquisition and data reduction instrumentation, including the acoustic systems utilized to identify and rank sources of noise emanating from a given object, are oftentimes mounted within shipping cases to protect the expensive equipment during shipment from location to location. While the equipment can be packed within the shipping case in a variety of manners, the equipment is oftentimes rack mounted within the shipping case such that the equipment and the shipping case form an integral unit. These cases generally have a rugged exterior and may be formed of a metal, a hard plastic or the like. The interior of these cases is typically padded to further protect the contents. For example, one type of shipping case is an Anvil® case available from Caltron Packaging Group of City of Industry, California.

Shipping cases can also include casters. As such, the shipping cases can be rolled from place to place in order to properly position the equipment. While the casters facilitate movement of the shipping cases and the equipment disposed within the shipping cases, the casters create several problems during shipment of the cases. In this regard, the shipping cases and the equipment disposed within the shipping cases are oftentimes quite heavy and must be loaded and unloaded with forklifts or other heavy equipment. Since the shipping cases do not include an undercarriage that is easily engaged by a forklift, the forklift may damage the shipping case and the enclosed equipment while loading and unloading the shipping case. As such, specific instructions must typically be given to a forklift operator regarding the need to be careful with the shipping case in order to reduce the likelihood that the shipping case and the enclosed equipment will be damaged by the forklift.

Additionally, the shipping cases are not generally designed to have the casters support the entire weight of the shipping case and the enclosed equipment during shipment. In this regard, the movement and the vibration of the shipping case during shipment combined with the weight of the shipping case and the enclosed equipment may damage the casters. As such, the useful lifetime of the casters may be reduced, thereby requiring the casters to be replaced sooner than desired. The replacement of the casters will, in turn, take some time during which the shipping case and the enclosed equipment will generally be unavailable and will incur some cost due to the parts and labor required for the repair. As a result being mounted upon casters, shipping cases may also roll about during shipment, thereby further increasing the possibility that the shipping case or the enclosed equipment may be damaged. Accordingly, the shipping cases must typically be strapped to a fixed portion of a cargo compartment, such as a wall or the like.

Since the shipping cases are oftentimes relatively expensive and the equipment housed within the shipping cases may cost tens or hundreds of thousands of dollars, it is desirable to minimize the possibility of damage to a shipping case and the enclosed equipment. As such, custom pallets or crates have been constructed to support shipping cases that have casters during shipment. In these instances, the shipping case is rolled up a ramp and onto a custom pallet or crate. The shipping case is then tilted such that one side of the case is raised. A block or support is then inserted under the side of the case that has been raised. The block is connected to the pallet and the shipping case is then lowered onto the block. The process of tilting the shipping case such that an edge is raised into the air is repeated for each side of the shipping case until blocks have been placed under each side of the shipping case. The shipping case is then banded onto the pallet, typically with disposable metal banding.

While the custom pallets or crates address the shortcomings described above in conjunction with the shipment of shipping cases in a non-palletized manner, the process of loading a shipping case upon a custom pallet is quite time consuming and generally requires several individuals to move and position the shipping case. Additionally, the custom pallet generally includes a plurality of loose parts that may be lost or misplaced and the process of loading a shipping case upon the custom pallet requires a number of tools to connect the parts. As such, it would be desirable to further improve the process of shipping a shipping case disposed upon casters in order to permit the shipping case to be loaded and unloaded in a fairly simple fashion by no more than one or two individuals while continuing to minimize the possibility of damage to the shipping case and the enclosed equipment.

SUMMARY OF THE INVENTION

An improved pallet and an associated method are therefore provided that are capable of supporting an item, such as a shipping case that is mounted upon casters, so as to reduce the possibility that the item will be damaged during shipment or during its loading or unloading. Additionally, the improved pallet and associated method of the present invention permit an item, such as a shipping case disposed upon casters, to be loaded onto and unloaded from the pallet in a relatively simple manner such that one or two individuals can load and unload the item, if necessary.

The pallet includes a pallet deck having a support surface for supporting the item. Typically, the pallet deck includes a fore edge over which the item is initially loaded upon the pallet deck, an aft edge disposed opposite the fore edge and a pair of side edges extending in a longitudinal direction between the fore and aft edges. The pallet deck includes a fixed portion, typically disposed proximate the fore edge and extending along the pair of side edges. According to one advantageous embodiment, the pallet deck also includes a movable portion proximate the fixed portion. The movable portion is capable of moving between a first position in which the movable portion is displaced from the fixed portion and a second position in which the movable portion and the fixed portion cooperate to define the support surface for supporting the item. For example, the movable portion may be connected to the fixed portion, such as by a hinged connection, such that the movable portion can be rotatedly downwardly into the first position.

The movable portion is generally in the second position while the item is loaded upon and unloaded from the pallet. The movable portion is moved to the first position, however, during shipment and storage of the item. The pallet also includes a support disposed upon the fixed portion of the pallet deck for supporting the item once the movable portion is in the first position. Prior to movement of the movable portion into the first position, however, the item is typically spaced apart from the support. For an item mounted upon casters, for example, the casters are typically supported by the pallet deck, while the movable portion is in the second position with the lower surface of the item being disposed in a spaced relation to the support.

In one embodiment, the support includes a stationary portion that is mounted in a fixed position upon the pallet deck and a movable portion connected to the stationary portion. The movable portion is capable of moving from a retracted position during loading and unloading of the item to an extended position in which the movable portion extends beyond the stationary portion following loading of the item for subsequent support of the item during shipment and storage. In one advantageous embodiment, the pallet includes a pair of supports having respective stationary portions disposed upon the side edges of the pallet deck. In this embodiment, the movable portions may be hingedly connected to respective stationary portions such that each support preferably extends along at least 60% of a respective side of the item once the movable portions are in the extended position. Additionally, each support can include an engagement member, such as a pin, for engaging the pallet deck in order to secure the movable portion of the support in a respective position, such as the retracted position or the extended position.

The support may include a medial support disposed upon a medial portion of the pallet deck. The medial support includes a movable medial support and a stationary medial support. The movable medial support is movable between a retracted position during loading and unloading of the item and an extended position in which the movable medial support is advanced towards the fore edge of the pallet deck during shipment and storage of the item. In contrast, the stationary medial support is disposed in a fixed position. While the movable medial support generally extends beyond the stationary medial support in the extended position, the stationary medial support and the movable medial support may be disposed proximate to one another in instances in which the movable medial support is in the retracted position. The pallet of this embodiment can also include an actuating member, such as a push rod, disposed in mechanical communication with the medial support such that actuation of the actuating member causes the medial support to move toward the fore edge of the pallet deck. In this regard, the pallet can include a longitudinally extending track for guiding the movement of the movable medial support. For example, one of the movable medial support and the stationary medial support can define the track, while the other medial support includes a slide for engaging the track.

The pallet can also include a ramp proximate one edge of the pallet deck to facilitate loading of an item upon the pallet deck. In this regard, the ramp is preferably positioned relative to the pallet deck such that the fixed portion of the pallet deck is disposed between the ramp and the movable portion of the pallet deck. The ramp is typically hingedly connected to the fixed portion of the pallet deck. Additionally, the ramp generally includes a spacer for operably contacting the item once the ramp is folded upwardly about the item during shipping The fixed portion of pallet deck can also include an angled portion proximate the ramp and opposite the movable portion of the pallet deck. The angled portion is designed to support one or more casters of the item such that the item is maintained in a relatively level orientation once the movable portion of the pallet deck is moved into the first position by being displaced from the fixed portion of the pallet deck.

In operation, an item is initially rolled up the ramp onto the support surface of the pallet deck. The item is supported upon the pallet deck so as to be spaced from the supports disposed upon the pallet deck beneath the item. For example, the casters of the item are generally supported by the pallet deck with the lower surface of the item being spaced above the supports. More particularly, the casters are generally supported by the movable portion of the support deck and the angled portion of the fixed portion of the pallet deck. Once the item is positioned upon the support surface, the supports can be extended toward the fore edge of the pallet deck. For example, one or, more commonly, a pair of side supports and a medial support can be extended towards the fore edge of the pallet deck. The movable portion of the pallet deck is then displaced from the fixed portion of the pallet deck such that the item primarily rests upon and is supported in a relatively level orientation by the underlying supports. Thereafter, the ramp is folded upwardly alongside the item and packing straps or the like are wrapped about the pallet and the item.

As a result of its construction, the pallet of the present invention can readily receive and support an item that is mounted upon casters. As such, the pallet facilitates the loading and unloading of the item by means of a forklift or other mechanical equipment and prevents movement of the item during shipment since the item no longer rests upon the casters. In addition, the lower surface of the item is supported by the pallet such that the majority of the weight of the item is removed from the casters, thereby preventing unnecessary damage to the casters during shipment. The pallet also advantageously has no loose parts and generally requires no tools to load and unload an item, other than a pallet jack, a forklift or the like. Since, the pallet to the present invention is also designed to facilitate the loading and unloading of items upon the pallet, most items can be loaded onto and unloaded from the pallet by one or two individuals, thereby further simplifying the shipping process, particularly with respect to items mounted on casters.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
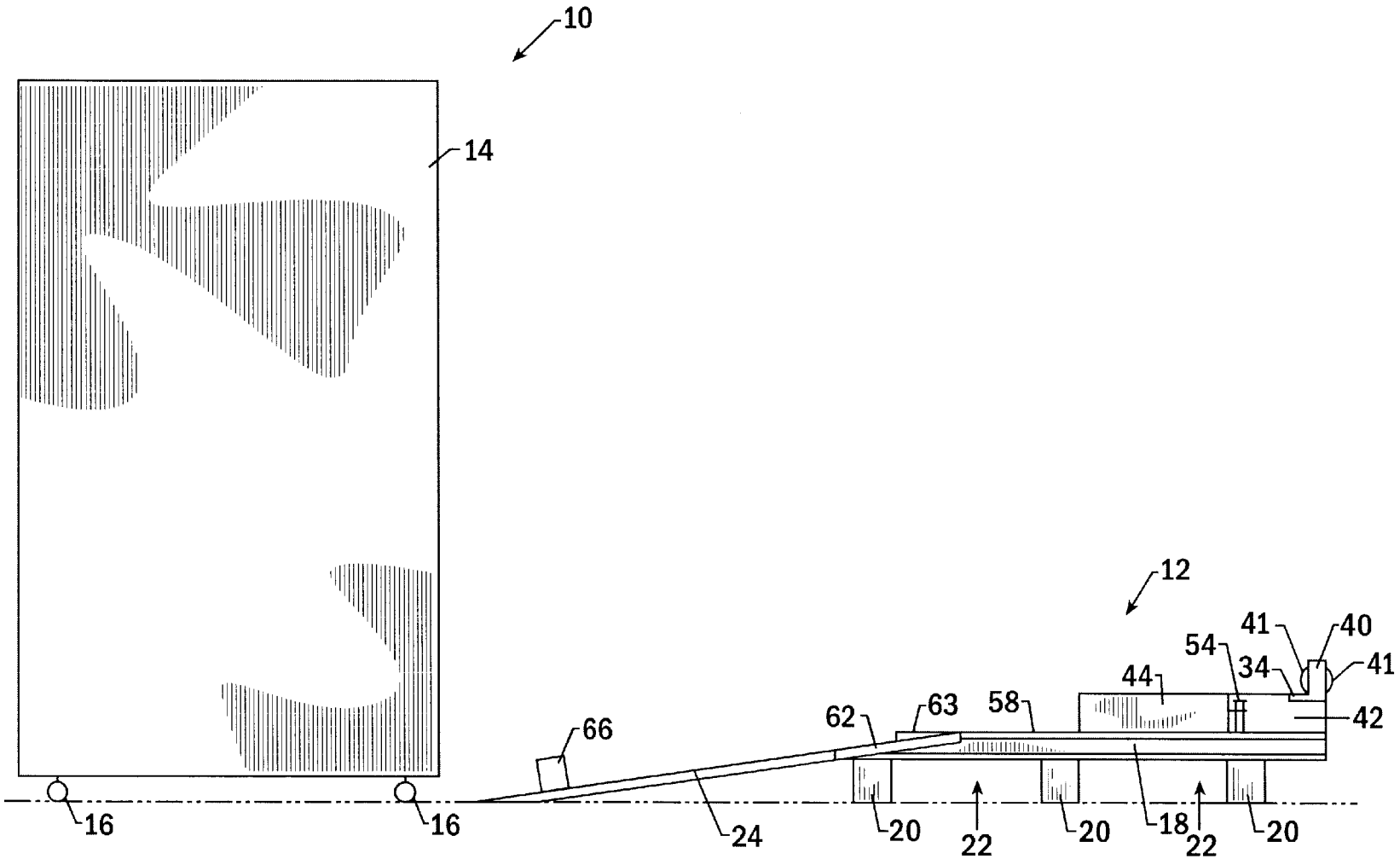
FIG. 1 is a side view of a pallet according to one embodiment of the present invention and an item that will be loaded upon the pallet.

Referring now to FIG. 1, an item 10 to be shipped is depicted proximate a pallet 12 according to one embodiment to the present invention. In a common example, the item is a shipping case 14 mounted upon a plurality of casters 16 such that the shipping case can be rolled about and positioned as desired. The shipping case can be designed to protect a variety of equipment, such as electronic equipment mounted upon racks within an internal compartment defined by the shipping case. In order to protect the equipment, the shipping case is generally formed of a durable and rugged material, such as a metal, a hard plastic or the like. Additionally, the shipping case generally includes padding within the internal compartment for further protecting the equipment. Although a shipping case for storing rack mounted equipment is generally relatively tall and rectangular solid in shape, the shipping case can have other shapes and can be constructed in other manners for storing different types of goods without departing from the spirit and scope of the present invention.

Figure 2:
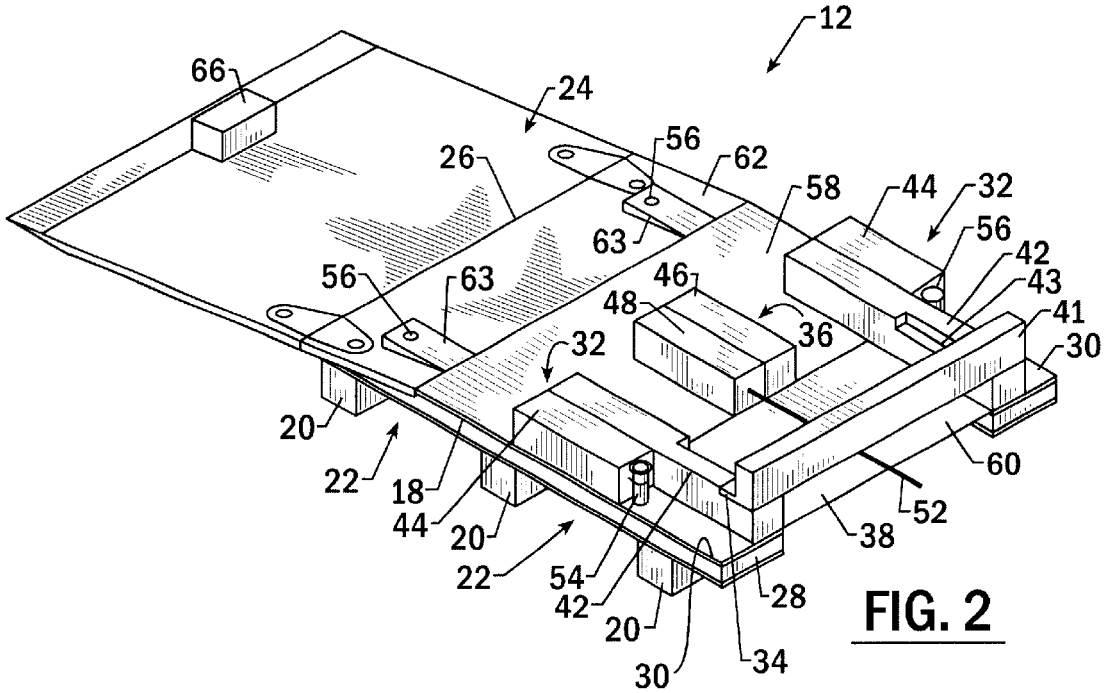
FIG. 2 is a perspective view of a pallet according to one embodiment of the present invention in which the supports are retracted and the movable portion of the pallet deck is in the second position.

As shown in more detail in FIG. 2, the pallet 12 includes a pallet deck 18 having a support surface for supporting the item. As explained in detail below, for an item 10 mounted upon casters 16, the pallet deck is designed to support the casters and, in turn, the item riding upon the casters once the item is loaded onto the pallet. The pallet also includes an undercarriage, typically formed of a plurality of cross members 20 that define a pair of elongate channels 22. The cross members can extend in a continuous manner across the entire width of the pallet. Alternatively, the cross members can be segmented. The undercarriage serves to space the pallet deck from the floor or other surface upon which the pallet is placed and the elongate channels are adapted to receive the forks of a forklift. As such, a forklift can readily lift the pallet without damaging the item disposed upon the pallet.

The pallet 12 also generally includes a ramp 24. As depicted, the ramp extends or slopes downwardly from one edge of the pallet deck 18 to the floor or other surface upon which the pallet is placed. As such, an item 10 can be rolled up the ramp and onto the pallet deck, typically by a single person. While the ramp need not be connected to the pallet deck, the ramp is preferably hingedly connected to one edge of the pallet deck. As such, the ramp can be lowered into the position depicted in FIG. 1 while the item is being loaded onto the pallet or unloaded from the pallet. Once the item is positioned upon the pallet deck, however, the ramp can be folded upwardly so as to extend at least partially along one side of the item as described and illustrated hereinbelow.

Figure 3:
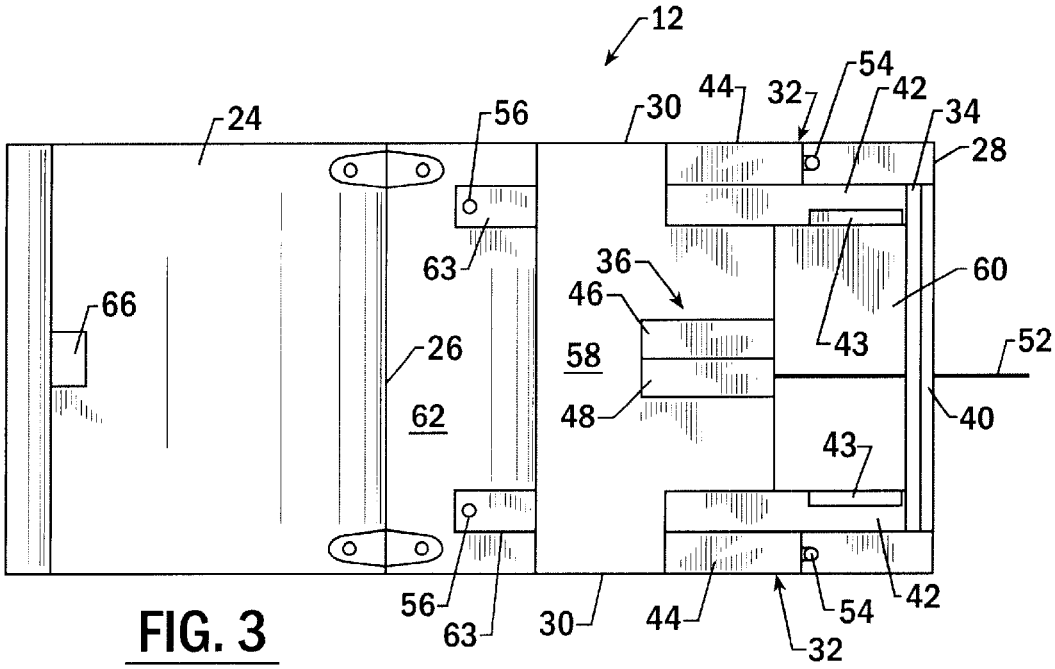
FIG. 3 is a top view of the pallet of FIG. 2.

Based upon the position of the ramp 24 relative to the pallet deck 18 and the corresponding direction in which the item 10 will be loaded upon and unloaded from the pallet deck, the respective edges of the pallet deck are designated as the fore edge 26, the aft edge 28 and the opposed side edges 30, as depicted in FIGS. 2 and 3. In this regard, the edge of the pallet deck proximate the ramp is the fore edge, while the edge of the ramp opposite the fore edge is the aft edge. In addition, the pair of side edges extend between the fore and aft edges on opposite sides of the pallet deck. The pallet deck also generally defines a longitudinal direction extending along the length of the pallet between the fore and aft edges, i.e., in the direction in which the item moves relative to the pallet deck during loading and unloading. For example, the side edges extend in the longitudinal direction.

The pallet 12 also includes at least one and, more typically, a plurality of supports disposed upon the pallet deck 18 and adapted to support an item 10 during shipment and storage. In the illustrated embodiment, the pallet includes a pair of side supports 32 extending along the opposed side edges 30 of the pallet deck and an aft support 34 extending along the aft edge 28 of the pallet deck. Additionally, the pallet of the illustrated embodiment includes a medial support 36 disposed upon a medial portion of the pallet deck.

While the aft support 34 can be configured in various manners, the aft support of one embodiment extends between and is supported by the pair of opposed side supports 32. As such, an opening 38 is defined between the underside of the aft support and the pallet deck 18. The opposed ends of the aft support are preferably connected to the side supports, such as by means of a screw, a bolt or the like. Preferably, the respective ends of the side supports upon which the aft support is mounted define a notch having a depth that substantially equals the thickness of the aft support such that the upper surfaces of the aft and side supports lie in a common plane. In this regard, the screw, bolt or the like that connects the aft support to the side supports is preferably countersunk so as not to extend upwardly beyond the upper surfaces of the side and aft supports.

The pallet 12 can also include an aft stop 40 proximate the aft edge 28 of the pallet deck 18. The aft stop generally includes an upstanding member that serves to prevent the item 10 from being slid across the pallet deck and off of the aft edge of the pallet deck. In the illustrated embodiment, the aft support 34 and the aft stop are an integral L-shaped structure. However, the aft support and the aft stop can be separate structures, if so desired. Although not necessary for the practice of the present invention, the aft stop can include protective members 41, such as wooden blocks, mounted upon one or both of the opposed surfaces of the upstanding member in order to protect the upstanding member and to absorb some of the energy created upon the impact of an item with the aft stop. As depicted in FIG. 1, the protective members typically have a generally rounded exterior surface. It is noted, however, that the protective members are not depicted in the other figures in order to more clearly depict other features of the pallet 12.

The supports that extend in the longitudinal direction, that is, the side and medial supports, are preferably designed to be at least partially movable. In this regard, the side and medial supports can move between a retracted position during loading and unloading of the item 10 (see FIGS. 2 and 3) and an extended position following loading of the item and during support of the item during shipping, storage or the like (see FIGS. 5 and 6). While the supports can be extended in a variety of manners without departing from the spirit and scope of the present invention, supports that are capable of being extended in two different manners will be described hereinbelow for purposes of illustration but not of limitation.

Figure 4:
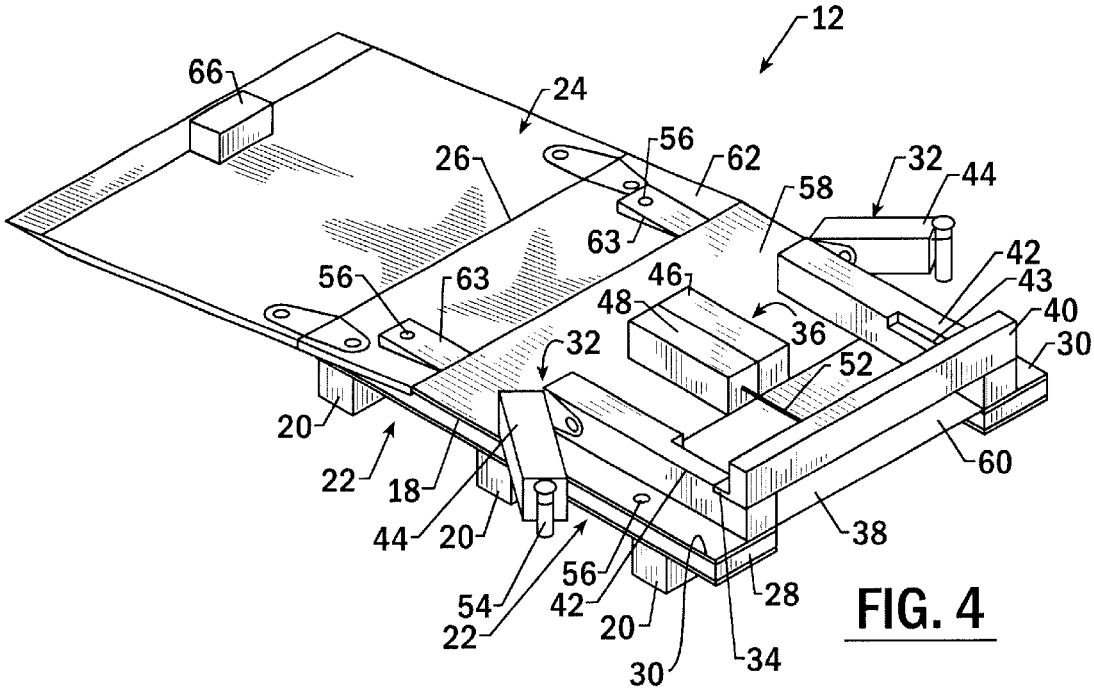
FIG. 4 is a perspective view of the pallet of FIGS. 2 and 3 in which the supports are in the process of being extended.
Figure 5:
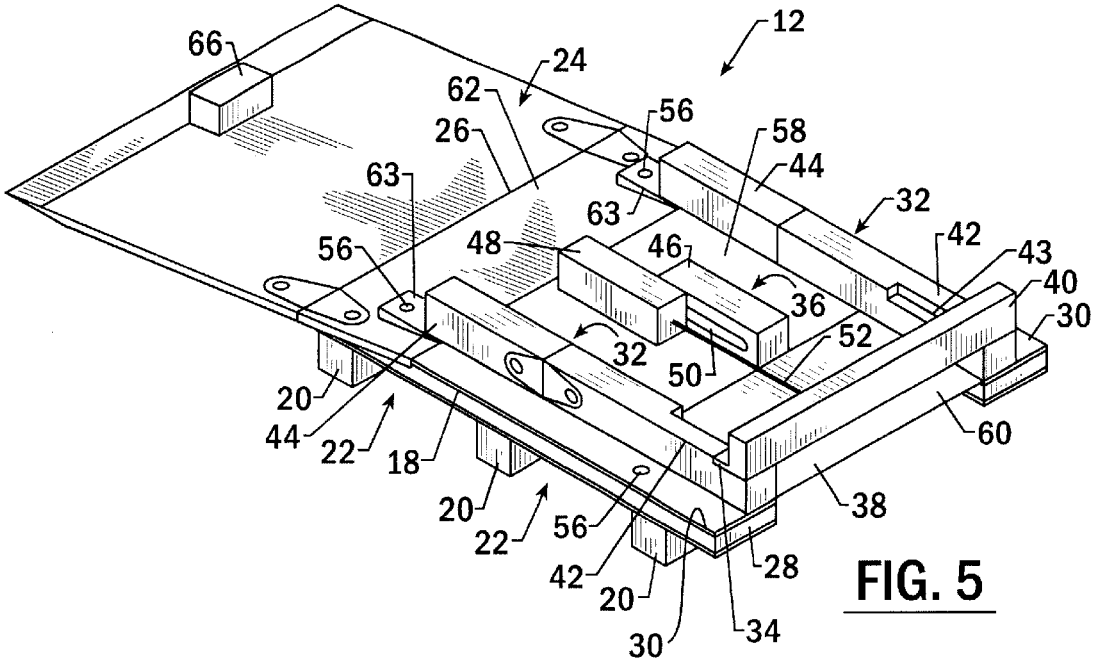
FIG. 5 is a perspective view of the pallet of FIGS. 2–4 in which the supports are extended and the movable portion of the pallet deck is in the first position.
Figure 6:
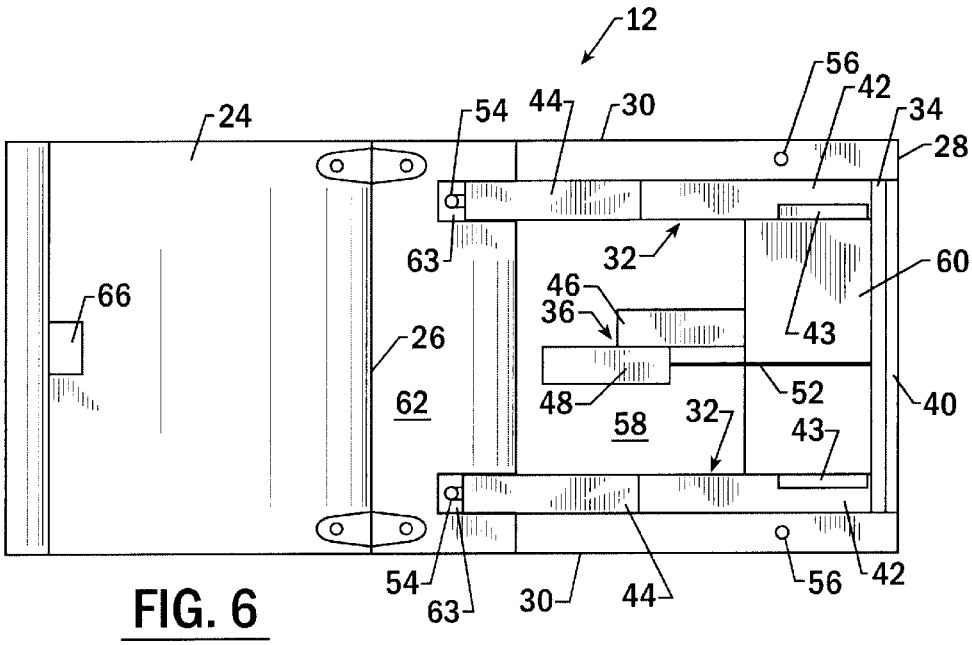
FIG. 6 is a top view of the pallet of FIG. 5.

In the illustrated embodiment, the side supports 32 include a stationary portion 42 that is mounted in a fixed position upon the pallet deck 18 and a movable portion 44 connected to the stationary portion. The movable portion is capable of moving between a retracted position proximate the stationary portion during loading and unloading of an item 10 and an extended position in which the movable portion extends beyond the stationary portion in the longitudinal direction following the loading of the item for support of the item during subsequent shipment and storage. While the movable portion can be connected to the stationary portion in various manners, the stationary and movable portions are hingedly connected in one advantageous embodiment. As such, the movable portion can be swung from the retracted position depicted in FIGS. 2 and 3 in which the movable portion lies alongside the stationary portion through an intermediate position depicted in FIG. 4 to an extended position as shown in FIGS. 5 and 6 in which the movable portion is disposed in line with the stationary portion, albeit much closer to the fore edge 26 of the pallet deck than the stationary portion. Once extended, the side supports preferably extend along at least 60% and, more preferably, along at least 80% of the length of the item to be carried by the pallet 12. By supporting the item along both of the opposed sides and the aft edge 28, the pallet of the present invention provides a stable platform for the item in order to minimize the risk that the item may tip during shipment.

Although not necessary for the practice of the present invention, each side support 32, and more particularly, the movable portion 44 of each side support can include an engagement member 54 for engaging the pallet deck 18 in order to secure the movable portion in position. In one embodiment, the engagement member is a spring loaded locking pin mounted to the distal end of the movable portion of each side support and biased downwardly toward the pallet deck. In this embodiment, the pallet deck defines corresponding openings 56 in alignment with the spring loaded locking pin in instances in which the movable portion of each side support is in the retracted position and in the extended position. As such, the spring loaded locking pin can engage a respective opening defined by the pallet deck in order to secure the movable portion in the desired position. In order to move the movable portion of the side support, the spring loaded pin can be removed from the corresponding opening defined by the pallet deck, the movable portion can be moved to the other position and the pin can be inserted into the other hole defined by the pallet deck in order to secure the movable portion of the side support in its new position.

Similar to the side supports 32, the medial support 36 also generally includes a stationary medial support 46 and a movable medial support 48, both of which are disposed upon a medial portion of the pallet deck 18. While the movable medial support could be hingedly connected to the stationary medial support so as to be moved between retracted and extended positions in the same manner as described in conjunction with the side supports, the movable medial support of the illustrated embodiment is adapted to move between retracted and extended positions in another manner. In this regard, the movable medial support and the stationary medial support of are generally disposed proximate to one another while the movable medial support is disposed in a retracted position during loading and unloading of an item 10, as shown in FIGS. 2 and 3.

Following loading of the item 10, however, the movable medial support is generally moved to an extended position in which the movable medial support extends beyond the stationary medial support 46 in the longitudinal direction so as to be closer to the fore edge 26 of the pallet deck 18, as shown in FIGS. 5 and 6. In this regard, the pallet 12 generally defines a longitudinally extending track 50 for guiding the movement of the movable medial support. In the illustrated embodiment, the surface of the stationary medial support that faces the movable medial support defines the lengthwise extending track. As such, the movable medial support can include a slide extending outwardly from the surface that faces the stationary medial support for engaging the track defined by the stationary medial support. As such, once the item has been loaded upon the pallet deck, the movable medial support can be urged along the track toward the fore edge of the pallet deck and into the extended position. While the stationary medial support of the illustrated embodiment defines the track, other components of the pallet can define the track in other embodiments. For example, the movable medial support can define the track and the stationary medial support can include the slide. Alternatively, the pallet deck can define the track for engaging a slide carried by the movable medial support.

In order to assist the movement of the movable medial support 48, the pallet 12 can include an actuating member 52 disposed in mechanical communication with the movable medial support. As illustrated in FIGS. 2, 4 and 5, the actuating member can be a pushrod that extends from the movable medial support through the opening 38 between the aft support 34 and the pallet deck 18 so as to be grasped by the individual loading the item 10 upon the pallet. By forcing the pushrod in a longitudinal direction toward the fore edge 26 of the pallet deck, the movable medial support is moved into the extended position. Alternatively, by pulling the pushrod in the longitudinal direction toward the aft edge 28 of the pallet deck, the movable medial support is moved into the retracted position alongside the stationary medial support 46.

While the medial support 36 can be designed to extend as far or further toward the fore edge 26 further than the side supports 32, the movable medial support 48 is generally designed to stop short of the side supports such that the fore end of the movable medial support is slightly further from the fore edge of the pallet deck 18 than the distal end of the side supports once all of the supports are in the extended position. In the illustrated embodiment, for example, the extension of the movable medial support is limited by the length of the track 50 defined by the stationary medial support 46 which, in turn, is generally much shorter than the stationary portion 42 of the side supports.

The pallet deck 18 includes both a fixed portion 58 and a movable portion 60 that is proximate the fixed portion. While the movable portion can have a variety of different sizes depending upon the application, the movable portion generally is between about 25% and 45% and, more typically, about 35% of the size of the planar section of the fixed portion, i.e., the area of the fixed portion once the area of the angled portion 62 that is described below is excluded. Generally, the fixed portion is proximate the fore edge 26 of the pallet deck, while the movable portion is proximate the aft edge 28 of the pallet deck. In addition, the fixed portion of the pallet deck preferably extends along both of the opposed side edges 30. Thus, the side supports 32 and the medial support 36 are all preferably mounted upon the fixed portion of the pallet deck. The movable portion is adapted to move between a first position in which the movable portion is displaced from the fixed portion. In this first position, the movable portion is generally angled downwardly from the fixed portion toward the floor or other underlying surface upon which the pallet 10 is disposed as shown in FIG. 5. In the first position, the movable portion 60 of the pallet deck 18 can be angled downwardly by various amounts. In the illustrated embodiment, for example, the movable portion is angled downwardly at an angle of about 5° to 15° and, more typically, about 10°. In this regard, the movable portion can be displaced downwardly until a lower surface of the movable portion contacts the aftmost cross member 20. By stopping the downward displacement of the movable portion of the pallet deck above the floor, the pallet of this embodiment advantageously provides for the fork of a pallet jack or the like to be inserted between the floor and the movable portion in order to raise the movable portion as described below. However, the pallet may be configured such that the movable portion can be angled downwardly to contact the floor, if so desired.

The movable portion 60 is also capable of being placed in a second position in which the movable portion and the fixed portion 58 cooperate to define the support surface for supporting the item 10. In this regard, the movable portion and the fixed portion generally define a substantially planar support surface in instances in which the movable portion is in the second position. In order to facilitate the movement of the movable portion of the pallet deck 18 relative to the fixed portion of the pallet deck, the fixed and movable portions of the pallet deck are preferably hingedly connected, such as by means of a piano hinge that extends between the opposed side edges 30 of the pallet deck and that is positioned on the underside of the pallet 12, i.e., on the side of the pallet facing the floor.

Figure 7:
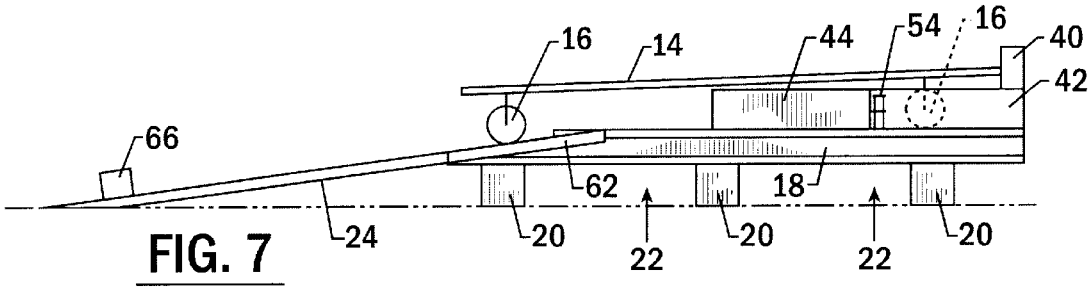
FIG. 7 is a side view of a pallet according to one embodiment of the present invention following the loading of an item upon the pallet and in which the supports remain in the retracted position.

The operation of the pallet 12, including the movement of the movable portion 60 of the pallet deck 18 and the movement of the movable portions of the supports, will now be described in conjunction with the loading, transporting and unloading of an item 10 on the pallet. In order to load an item upon the pallet, the ramp 24 is folded down to the position shown in FIG. 1. In addition, the movable portions of the supports are disposed in the retracted position, and the movable portion of the pallet deck is raised to the second position such that the movable and fixed portions of the pallet deck define a substantially planar support surface. See FIGS. 1–3. In order to raise the movable portion of the pallet deck, a pallet jack can be placed beneath the aft edge 28 of the pallet so as to underlie the movable portion of the pallet deck. By raising the pallet jack, the movable portion of the pallet deck can also be raised to the second position. For purposes of illustration, however, the movable portion is simply depicted in the second position without an indication as to the means, such as a pallet jack, for maintaining the movable portion in the second position. The item is then rolled on its casters 16 up the ramp and onto the pallet deck. In this position, the casters are supported by the pallet deck, with some casters being supported by the movable portion of the pallet deck and other casters being supported by the fixed portion of the pallet deck, as shown in FIG. 7. As a result of the ground clearance provided by the casters, the lower surface of the item, i.e., that surface of the item facing the pallet, is disposed in a spaced relation to the supports such that the supports do not contact and do not support the item. It is noted with respect to FIGS. 7–9 that that only the lower surface and the castors of the item are depicted and that one of the castors and the movable portion 60 of the pallet deck are shown in dashed lines for purposes of illustration since they otherwise would be hidden from view in the side views.

Figure 8:
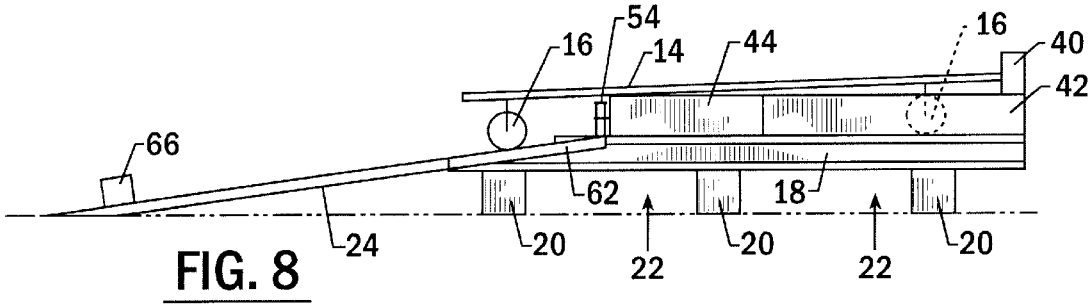
FIG. 8 is a side view of the pallet of FIG. 7 in which the supports have been extended.
Figure 9:
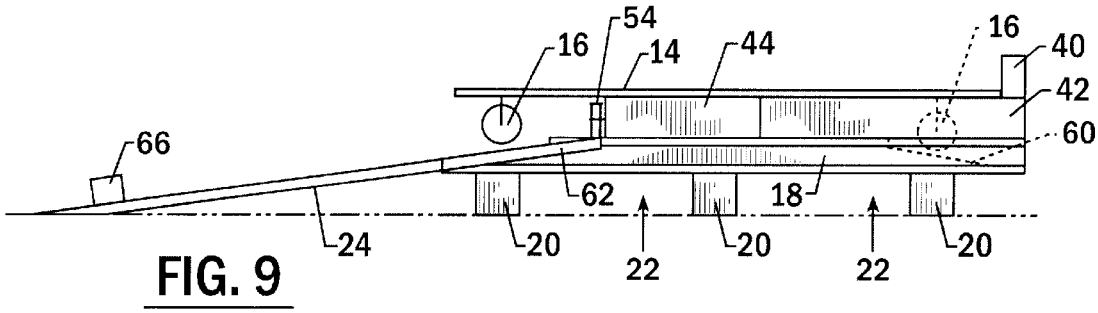
FIG. 9 is a side view of the pallet of FIGS. 7 and 8 in which the movable portion of the pallet deck has been lowered into the first position such that the lower surface of the item rest upon the supports, thereby blocking the item.

The supports are then moved from the retracted position to the extended position as shown in FIG. 8. In this regard, the engagement member 54 of each side support 32 is disengaged from the respective opening 56 defined by the pallet deck 18, and the movable portion 44 of the side support is swung forwardly into the extended position. The engagement member is then permitted to engage another opening defined by the pallet deck. Additionally, the actuating member 52 is actuated in order to advance the movable medial support 48 toward the fore edge 26 of the pallet deck and into the extended position. Once the supports have been extended, the movable portion 60 of the pallet deck is moved from the second position into the first position, as shown in FIG. 9. For example, the movable portion of the pallet deck can be lowered into the first position by lowering the pallet jack toward the floor or other surface upon which the pallet 12 is disposed. As a result of lowering the movable portion of the pallet deck, the item 10 is also lowered onto the supports, namely, the side, medial and aft supports. In particular, at least some of the casters 16 of the item are supported by the movable portion of the pallet deck such that lowering of the movable portion of the pallet deck causes the item to pivot about the ends of the supports that are nearest to the fore edge until the lower surface of the item sits flush upon the supports.

In order to insure that the item 10 is fully supported by the supports, the fixed portion 58 of the pallet deck 18 also generally includes an angled portion 62 along the fore edge 26 of the pallet deck proximate the ramp 24. The angled portion is positioned such that the casters 16 of the item that do not rest upon the movable portion of the pallet deck are supported by the angled surface. Moreover, this angled portion generally angles downwardly toward the floor or other surface upon which the pallet 12 is disposed at approximately the same angle defined by the movable portion 60 of the pallet deck in the first position, such as about 5° to 15° and, more typically, about 10° in one embodiment. Thus, once the movable portion of the pallet deck has been lowered into the first position, the item is effectively blocked since the weight of the item is completely removed from the casters as a result of the castors being spaced somewhat from both the angled portion and the movable portion as shown in FIG. 9. While the castors can be spaced from the pallet deck by any desired amount, the pallet of one embodiment provides for a gap of about one-eighth of an inch once the movable portion of the pallet deck has been lowered into the first position.

The distal end of the movable portion 44 of each side support 32 overlies the angled portion 62 in the extended position in the illustrated embodiment. In order to support the distal end of the movable portion, the angled portion can include a wedge-shaped buildup 63 that underlies the distal end of the movable portion of each side support. The wedge-shaped buildups provide a solid backing for the distal end of the movable portions in order to more securely support the item. As shown, the wedge-shaped buildups also define respective openings 56 for receiving engagement members 54, such as the locking pins, carried by the distal end of the movable portion of the side supports.

In order to further insure that the item 10 sits flush upon the supports, the supports can be designed to accommodate the base of the castors 16. In this regard, the castors generally include a base that is mounted to the lower surface of the item. In order to permit the supports and, more particularly, the stationary portions 42 of the side supports 32 to contact the lower surface of the item instead of the base of the castors, the stationary portions can define a lengthwise extending notch 43. As such, the base of the castors fits within the notch, while the lower surface of the item contacts and rests flush upon the upper surface of the side supports.

Figure 10:
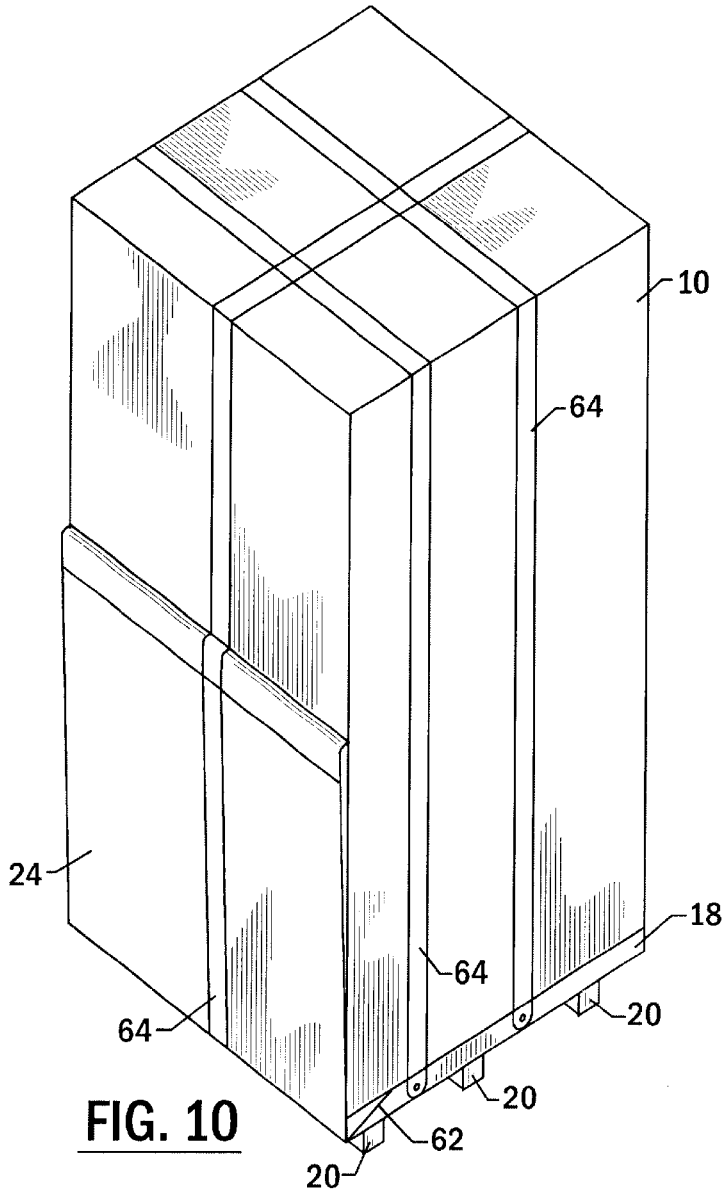
FIG. 10 is a perspective view of an item loaded upon a pallet according to one embodiment of the present invention.

Once the movable portion 60 of the pallet deck 18 has been lowered into the first position, the pallet jack can be removed. The ramp 24 can then be raised to an upstanding position extending alongside the item 10 as shown in FIG. 10. A plurality of straps 64 can then be wrapped about the item and the pallet 12 in order to secure the item to the pallet such that the item and the pallet can be moved as an integral unit. While various types of banding straps can be utilized to secure the item to the pallet, the straps of one embodiment are connected to the pallet and, more particularly, to the pallet deck and the aft stop 40, by means of bolts or the like. In this regard, the straps are shown to be connected to the pallet in FIG. 10. However, the straps as well as the means for connecting the straps to the pallet are not depicted in FIGS. 1–9 in order to more clearly depict other aspects of the present invention. In addition, while the banding straps can be formed of various materials, the pallet of one advantageous embodiment utilizes Kevlok® straps that are commercially available from AGM Container Controls of Tucson, Ariz. In order to ensure firm contact between the ramp and the adjacent side of the item, the ramp can include a spacer 66 disposed proximate the distal edge of the ramp, i.e., the edge of the ramp closest to the floor in instances in which the ramp is folded down as shown in FIG. 1

Once the item 10 has been positioned upon and banded to the pallet 12, the palletized item can be readily moved by means of a forklift or the like. In addition, the palletized item will no longer roll about since the casters 16 are spaced from the floor or other surface upon which the pallet is disposed. Additionally, by supporting the item through the engagement of the lower surface of the item with the supports, the weight of the item is removed from the casters during shipment and storage. Thus, the pallet of the present invention should prevent damage that otherwise could be caused to the casters as a result of the movement and vibration of the item during shipment. The pallet also advantageously has no loose parts and generally requires no tools to load and unload an item, other than a pallet jack, a forklift or the like. Still further, the pallet of the present invention is specifically designed to facilitate the loading of an item, such as a shipping case, by one or two individuals in a safe manner since the item need not be tipped or otherwise moved in order to place supports under the sides or other portions of the items as required by conventional pallets.

Once the palletized item 10 has reached its destination and is to be unloaded, the banding straps 64 are initially removed and the ramp 24 is folded down. The movable portion 60 of the pallet deck 18 is then raised to the second position in which the movable portion and the fixed portion 58 cooperate to define a substantially planar support surface, as shown in FIG. 8. As described above, the movable portion can be raised in various manners, including being raised by a pallet jack. Once the movable portion of the pallet deck has been raised to the second position, the lower surface of the item is again spaced from the supports. As such, the supports can then be moved from the extended position to the retracted position as depicted in FIG. 7 and the item can then be rolled down the ramp and onto the floor or other surface upon which the pallet 12 is disposed in order to complete the unloading process. As with the loading of the item, the pallet of the present invention is advantageously designed to facilitate the unloading of an item, such as a shipping case, by only one or two individuals.

The pallet 12 of the present invention can be formed from a variety of different materials. For example, the entire pallet can be formed of a metal, a plastic, a wood or the like. In one embodiment, the majority of the pallet is formed of wood. In this embodiment, for example, the fixed portion 58 of the pallet deck 18, the undercarriage, the ramp 24 and the side and medial supports 32, 36 are formed of wood. With respect to the fixed portion of the pallet deck, the fixed portion can be formed of a plurality of layers of plywood to increase the relative strength of the pallet deck. In order to decrease the weight of the pallet, the internal or medial layer(s) of the pallet deck need not be continuous, but can be strips of plywood disposed in those regions that are anticipated to carry the largest loads. For example, the pallet deck may include a medial layer having a plurality of longitudinally extending strips of plywood, namely, strips that extend along each of the opposed edges and strips that extend along and underlie the anticipated path of travel of the castors 16 in order to appropriately support the item 10.

In contrast, the pallet 12 of one embodiment includes a movable portion 60 of the pallet deck 18 and an aft support 34 and an aft stop 40 that are formed of a metal, such as aluminum. Additionally, the pallet of this embodiment includes a metal plate disposed upon the upper surfaces of the side and medial supports to define a planar contact surface upon which to support the item 10 during shipment. By utilizing a metallic contact surface, the supports can be protected from damage caused through contact with the item. Still further, the distal edge of the ramp 24 can be covered by a metal sheet in order to define a precise edge and to prevent the edge from being damaged as a result of the rolling of items over the edge and onto the pallet deck. For example, a piece of aluminum can be wrapped over the distal edge of the ramp in one embodiment. As will be apparent to those skilled in the art, however, the pallet and the various components of the pallet can be formed of a variety of other materials without departing from the spirit and scope of the present invention.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A pallet comprising:

a pallet deck having a support surface for supporting an item, said pallet deck comprising a fixed portion and a movable portion proximate the fixed portion, the movable portion capable of moving between a first position in which the movable portion is displaced from the fixed portion and a second position in which the movable portion and the fixed portion cooperate to define the support surface for supporting the item; and a support disposed upon the fixed portion of said pallet deck for supporting the item once the movable portion is in the first position.

2. A pallet according to claim 1 wherein the movable portion is hingedly connected to the fixed portion.

3. A pallet according to claim 1 further comprising a ramp proximate one edge of said pallet deck to facilitate loading of the item upon said pallet deck, wherein the fixed portion of said pallet deck is disposed between said ramp and the movable portion of said pallet deck.

4. A pallet according to claim 3 wherein the fixed portion of said pallet deck comprises an angled portion proximate said ramp and opposite the movable portion of said pallet deck.

5. A pallet according to claim 3 wherein said ramp is hingedly connected to the fixed portion of said pallet deck, and wherein said ramp comprises a spacer for operably contacting the item once said ramp is folded about the item during shipping.

6. A pallet according to claim 1 wherein said pallet deck comprises a fore edge over which the item is initially loaded upon said pallet deck, an aft edge disposed opposite the fore edge and a pair of side edges extending between the fore and aft edges, and wherein the fixed portion of said pallet deck is proximate the fore edge and extends along the pair of side edges.

7. A pallet according to claim 6 wherein said support comprises side supports proximate respective side edges of said pallet deck.

8. A pallet according to claim 7 wherein each side support comprises:

a stationary portion that is mounted in a fixed position upon the fixed portion of said pallet deck; and a movable portion hingedly connected to the stationary portion, wherein the movable portion is capable of moving from a retracted position during loading of the item upon said pallet deck to an extended position in which the movable portion extends beyond the stationary portion following loading of the item for subsequent support of the item.

9. A pallet according to claim 6 wherein said support comprises a movable medial support disposed upon a medial portion of the fixed portion of said pallet deck for supporting an item following loading of the item upon said pallet deck, and wherein the pallet further comprises an actuating member disposed in mechanical communication with said medial support such that actuation of said actuating member causes said medial support to move toward the fore edge of said pallet deck.

10. A pallet comprising:

a pallet deck having a support surface including a movable means for lowering an item on the support surface; and at least one support disposed upon said pallet deck for supporting an item following loading of the item upon said pallet deck, said at least one support comprising:

a stationary portion that is mounted in a fixed position upon said pallet deck; and a movable portion connected to the stationary portion, wherein the movable portion is capable of moving from a retracted position during loading of the item upon said pallet deck to an extended position in which the movable portion extends beyond the stationary portion following loading of the item for subsequent support of the item.

11. A pallet according to claim 10 wherein said pallet deck comprises a fore edge over which the item is initially loaded upon said pallet deck, an aft edge disposed opposite the fore edge and a pair of side edges extending between the fore and aft edges, wherein the at least one support comprises a pair of supports having respective stationary portions disposed upon the side edges.

12. A pallet according to claim 11 wherein each support extends along at least 60% of a respective side of the item.

13. A pallet according to claim 10 wherein said movable portion is hingedly connected to said stationary portion.

14. A pallet according to claim 10 wherein said support further comprises an engagement member for engaging said pallet deck in order to secure the movable portion of said support in a respective position.

15. A pallet according to claim 10 wherein said support is a medial support, and wherein the stationary portion of the medial support is affixed to a medial portion of said pallet deck.

16. A pallet according to claim 15 wherein said pallet deck comprises a fore edge over which the item is initially loaded upon said pallet deck and an aft edge disposed opposite the fore edge, and wherein the movable portion of the medial support is capable of being slidably advanced toward the fore edge of said pallet deck.

17. A pallet according to claim 16 further comprising an actuating member disposed in mechanical communication with the medial support such that actuation of said actuating member causes the medial support to be slidably advanced toward the fore edge of said pallet deck.

18. A pallet comprising:

a pallet deck having a support surface including a movable means for lowering an item on the support surface, the support surface having a medial portion surrounded by a plurality of edge portions, wherein the edge portions comprise a fore edge over which an item is initially loaded upon said pallet deck and an aft edge disposed opposite the fore edge, and wherein said pallet deck defines a longitudinal direction extending through the fore and aft edges;

a movable medial support disposed upon the medial portion of said pallet deck for supporting an item following loading of the item upon said pallet deck; and an actuating member disposed in mechanical communication with said medial support such that actuation of said actuating member causes said medial support to move in the longitudinal direction.

19. A pallet according to claim 18 further comprising a stationary medial support disposed in a fixed position upon the medial portion of said pallet deck for supporting an item following loading of the item upon said pallet deck.

20. A pallet according to claim 19 wherein said movable medial support is movable between a retracted position during loading of the item upon said pallet deck and an extended position in which the movable medial support is advanced toward the fore edge of said pallet deck.

21. A pallet according to claim 20 wherein said movable medial support is disposed proximate said stationary medial support while in the retracted position.

22. A pallet according to claim 18 wherein said actuating member comprises a push rod connected to said movable medial support.

23. A pallet according to claim 18 further comprising a track for directing movement of said movable medial support.

24. A palletized assembly comprising:

a pallet comprising:

a pallet deck having a support surface, said pallet deck comprising a fixed portion and a movable portion proximate the fixed portion, the movable portion capable of moving between a first position in which the movable portion is displaced from the fixed portion and a second position in which the movable portion and the fixed portion cooperate to define the support surface; and at least one support disposed upon the fixed portion of said pallet deck; and an item supported by said at least one support of said pallet while the movable portion of said pallet deck is in the first position.

25. A palletized assembly according to claim 24 wherein said pallet further comprises a ramp hingedly connected along one edge of said pallet deck, and wherein said ramp comprises a spacer for operably contacting said item once said ramp is folded about said item during shipping.

26. A palletized assembly according to claim 24 wherein said pallet deck comprises a fore edge over which said item is initially loaded upon said pallet deck, an aft edge disposed opposite the fore edge and a pair of side edges extending between the fore and aft edges, and wherein said at least one support comprises side supports proximate respective side edges of said pallet deck.

27. A palletized assembly according to claim 26 wherein each side support comprises:

a stationary portion that is mounted in a fixed position upon the fixed portion of said pallet deck; and a movable portion connected to the stationary portion, wherein the movable portion is capable of moving from a retracted position during loading of said item upon said pallet deck to an extended position in which the movable portion extends beyond the stationary portion following loading of said item for subsequent support of said item.

28. A palletized assembly according to claim 24 wherein said pallet deck comprises a fore edge over which said item is initially loaded, upon said pallet deck, an aft edge disposed opposite the fore edge and a pair of side edges extending between the fore and aft edges, wherein said at least one support comprises a movable medial support disposed upon a medial portion of the fixed portion of said pallet deck for supporting said item following loading of said item upon said pallet deck, and wherein said pallet further comprises an actuating member disposed in mechanical communication with said medial support such that actuation of said actuating member causes said medial support to move toward the fore edge of said pallet deck.

* * * * *